US005322178A

United States Patent [19]

Foos

[11] Patent Number: 5,322,178

[45] Date of Patent: Jun. 21, 1994

[54] ONE-HAND OPERABLE LATCH FOR TUB TYPE CONTAINER

[75] Inventor: Douglas E. Foos, Barrington Hills, Ill.

[73] Assignee: Plastofilm Industries, Inc., Wheaton, Ill.

[21] Appl. No.: 51,092

[22] Filed: Apr. 21, 1993

[51] Int. Cl.[5] ..... B65D 43/22

[52] U.S. Cl. ..... 220/326; 220/324; 220/756; 220/771

[58] Field of Search ..... 220/324, 326, 4.23, 220/4.24, 339, 337, 756, 768, 771; 206/470, 815

[56] References Cited

U.S. PATENT DOCUMENTS

| | | | |
|---|---|---|---|
| 3,419,184 | 12/1968 | Asenbauer | 220/324 |
| 3,688,942 | 9/1972 | Mitchell et al. | 220/324 |
| 4,244,470 | 1/1981 | Burnham | 220/4.23 |
| 4,892,220 | 1/1990 | Foos . | |
| 4,917,261 | 4/1990 | Borst | 220/324 |
| 4,971,220 | 11/1990 | Kaufman | 220/339 |
| 4,986,438 | 1/1991 | Borst | 220/324 |
| 5,100,015 | 3/1992 | Vanderstuyf | 220/324 |
| 5,114,028 | 5/1992 | Ring | 220/771 |

*Primary Examiner*—Allan N. Shoap
*Assistant Examiner*—S. Castellano
*Attorney, Agent, or Firm*—Welsh & Katz, Ltd.

[57] ABSTRACT

A tub-type container having a one-hand operable latch includes a tub portion with an upper edge, a front wall, a rear wall and first and second side walls, the walls integrally joined to each other. A skirt depends from a peripheral edge of at least the front wall, and a forwardly projecting flange extends from the skirt along at least a portion of the front wall. The container also has a lid including a peripheral edge and front, rear, and first and second side portions corresponding to the walls of the container, the lid provided with a skirt depending from at least the front portion of the lid. The container is provided with a handle formation integrally formed into the skirt on the front side and projecting vertically above the peripheral edge, the handle formation being pivotable from a generally vertical closed position to a rearwardly projecting open position. A latch formation disposed at a lower edge of the skirt on the front side includes a groove formation for matingly engaging the flange of the tub portion, whereby rearward pressure on the handle disengages the groove formation from the flange to release the latch.

10 Claims, 1 Drawing Sheet

ONE-HAND OPERABLE LATCH FOR TUB TYPE CONTAINER

BACKGROUND OF THE INVENTION

The present invention relates generally to disposable plastic containers of consumer products, and specifically to packages designed for small, liquid-impregnated disposable paper or other absorbent sheets generally known as "wet wipes". Wet wipes are impregnated with a liquid which is intended for safe use on the tender skin of babies, and are usually supplied in a stack of folded sheets. Stacks of folded wet wipes are provided in a plastic tub-type container having a hinged lid which should be closed soon after the withdrawal of a wipe to retard evaporation of the liquid and the subsequent drying out of the wipes.

As any parent or other care provider of infants well knows, the successful changing of a baby's diaper is often a challenging task. During diaper changing, the baby is often upset, and simultaneously with intense crying, commonly kicks violently and squirms to escape the scene, if capable. Accordingly, the individual faced with the task of diaper changing commonly must keep one hand available for holding the baby, and the other for exchanging the fresh for the soiled diaper as well as wiping the baby's bottom.

Conventionally available containers for wet wipes are normally provided with hinged lids which seal to the tub with a releasable friction fit, both to retard evaporation and also to reduce the cost of manufacturing. Unfortunately, these same lids are often very awkward to open when only one hand is available. Since any delay in opening the wipes container prolongs the anxiety of diaper changing, both for the infant as well as the individual changing the diaper, frustration builds rapidly with conventional wipes boxes.

Another drawback of conventional wipes boxes is the inability to quickly grasp the box with one hand for movement from one point to another in the changing area. Such movement is often necessary for bringing the wipes within easy access of the diaper changer, or away from the inquisitive hands of an older baby.

Also, in the case of toddlers who are being toilet trained, and who often have limited strength and/or fine motor skill development, the difficulty in opening the wipes box often adds another obstacle to the already frustrating and daunting task of independently carrying out bodily functions without the use of diapers or the help of an adult.

In my commonly-assigned U.S. Pat. No. 4,892,220, I disclose a container for wet wipes boxes which is provided with semicircular formations on the lid and tub portion to serve as finger holes. The configuration of that patent is designed to be opened with one hand, preferably the thumb and forefinger. In practice, it was found to be somewhat awkward to quickly and properly insert the thumb and forefinger. Also, the prior latch configuration did not provide a formation for lifting the entire container, even when filled with wipes.

Consequently, a principal object of the present invention is to provide a tub-type container for disposable wipes having a latch which is readily and quickly operable with one hand.

Another object of the present invention is to provide a tub-type container having a latch which may also be used to lift the entire container using one hand, without opening the container.

SUMMARY OF THE INVENTION

Accordingly, the above-listed objects are met or exceeded by providing a tub-type wet wipes container having a raised handle formation on the lid which may easily be actuated to either open the container with a pushing action, or if desired, to lift the entire container by grasping the handle formation and pulling upward. A lower portion of the handle formation includes a releasable grooved latch which matingly engages a flange on the tub portion to effect the closure of the container.

More specifically, a tub-type container having a one-hand operable latch includes a tub portion with an upper edge, a front wall, a rear wall and first and second side walls, the walls integrally joined to each other, a skirt depending from a peripheral edge of at least the front wall and a forwardly projecting flange extending from the skirt along at least a portion of the front wall. The container also includes a lid including a peripheral edge and front, rear, and first and second side portions corresponding to the walls of the container, the lid provided with a skirt depending from at least the front portion of the lid. A hinge disposed at one of the portions of the lid and a corresponding one of the walls of the container secures the lid to the tub portion.

The container also includes a handle formation integrally formed into the skirt on the front side and projecting vertically above the peripheral edge, the handle being pivotable from a generally vertical closed position to a rearwardly projecting open position. A latch formation disposed on the skirt on the front side includes a groove formation for matingly engaging the flange of the tub portion, whereby rearward pressure on the handle formation disengages the groove formation from the flange to release the latch and open the lid.

A feature of the present latch configuration is that when a vertical load is applied, as occurs when the handle portion is grasped and lifted vertically, the present latch actually holds the tub flange tighter, preventing opening of the container while loaded. Although the novel latching and opening structure of the present invention is especially suitable for containers for wet wipes for babies, it will be appreciated that such latching structure may be advantageously employed in other containers as well.

DETAILED DESCRIPTION OF THE PREFERRED EMBODIMENT

Figure 1:
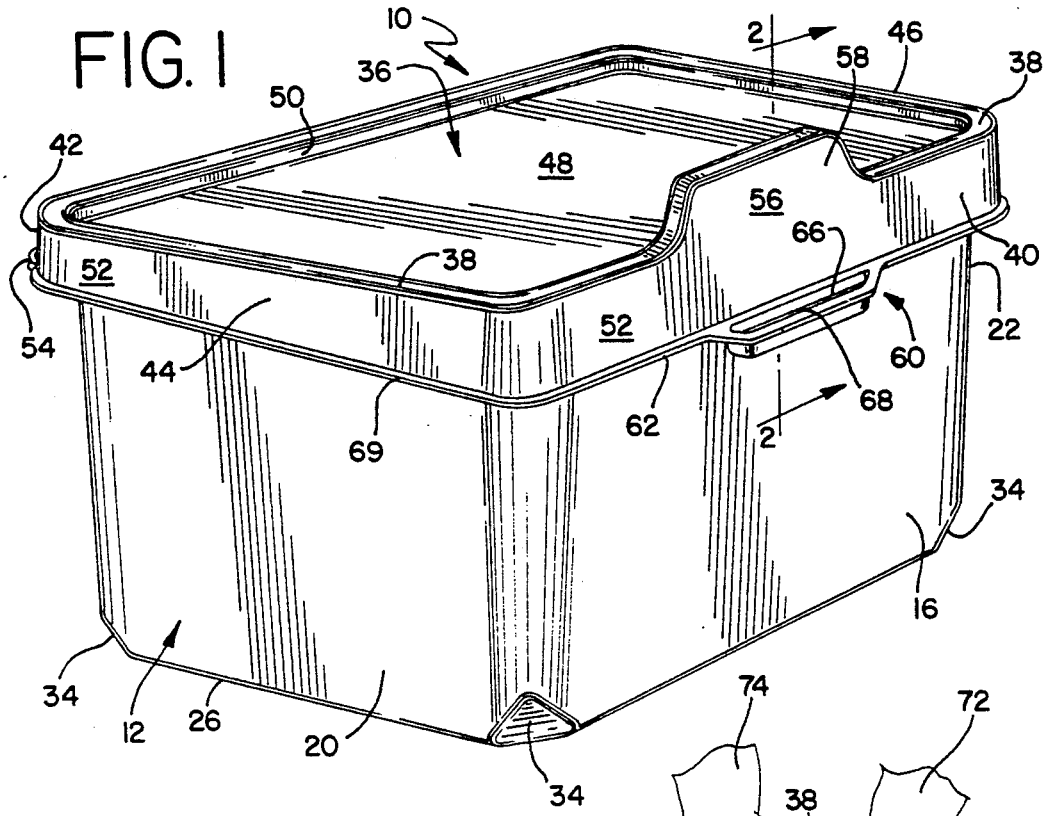
FIG. 1 is a top perspective elevational view of a tub-type container embodying the present one-handed latch.
Figure 2:
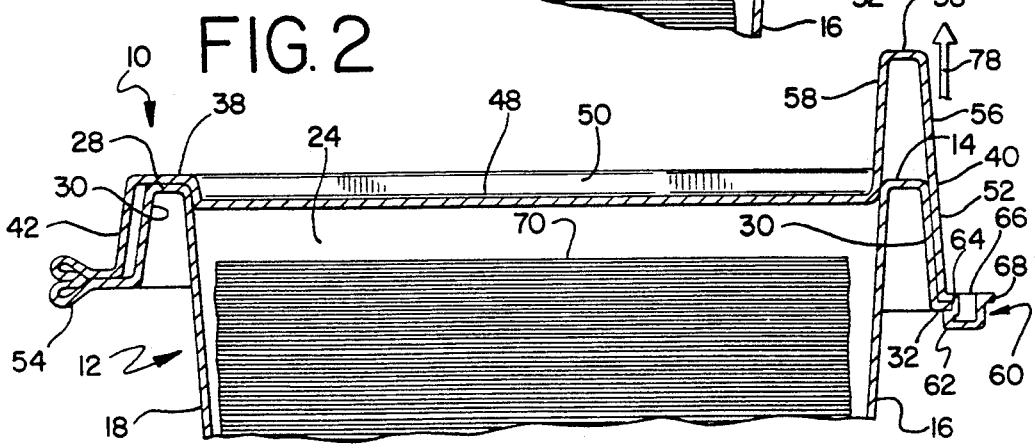
FIG. 2 is a section taken along the line 2—2 of FIG. 1 and in the direction indicated generally.

Referring now to FIGS. 1 and 2, a container is generally designated 10, and is preferably made of an inexpensive, yet durable grade of plastic. The exact type of plastic to be used depends in part on the type of liquid employed to saturate the wipes. If alcohol is used, certain plastics are unsuitable. One type of plastic which is especially suitable to the present container is high density polyethylene.

The container 10 may be produced by thermoforming a suitable plastic film which may be either transparent or opaque. Alternately, the present container 10 may also be conceivably manufactured by blow molding or injection molding.

More specifically, the container 10 includes a lower tub portion generally designated 12 with an upper edge 14, a front wall 16, a rear wall 18, and first and second side walls 20, 22, respectively. The walls 16, 18, 20, 22 are integrally joined to each other and define an open upper end 24. Lower edges of the walls 16–22 are also integrally joined by a floor 26. In the preferred embodiment, the container 10 is shaped so that the floor 26 has a smaller area than does the open upper end 24. This facilitates stacking of containers in shipping cartons, and also minimizes space occupied by the containers 10 on retailer's shelves.

Upper edge 14 includes a generally horizontal peripheral ledge 28 to which is attached a depending peripheral skirt 30. The skirt 30 depends from at least the front wall 16, however in the preferred embodiment, the skirt depends from the all four walls 16–22.

A forwardly, outwardly projecting flange 32 extends from the skirt 30 along at least a portion of the front wall 16. The four corners defined by the walls 16–22 are each provided with a generally triangular-shaped, truncated and inclined configuration 34 which has been found to increase the strength of the container 10.

The container 10 also includes a lid generally designated 36 which includes a peripheral edge 38 and front, rear, and first and second side portions, respectively designated 40, 42, 44 and 46, which correspond to the front rear and side walls 16–22. In the preferred embodiment, a top portion 48 is slightly sunken relative to the peripheral edge 38 for strength purposes, and is joined to the edge by a short wall 50.

In similar fashion to the tub portion 12, the lid 36 is provided with a skirt 52 depending from the peripheral edge 38 at least along the front portion 40. In the preferred embodiment, the skirt 52 extends around the entire periphery of the lid 36, and it will be seen that the skirt 52 is shorter in height at the rear of the container 10 adjacent the portion 42, than at the front portion 40. This reduces the amount of space taken up by containers 10 in a shipping carton when the containers are placed in front-to rear orientation.

A hinge 54 is preferably disposed at the rear portion 42 of the lid 36 and adjacent the rear wall 18 of the tub portion 12 of the container 10 for securing the lid to the tub portion. However, it is contemplated that the hinge may also be located along other walls of the container. Also, in the preferred embodiment, the hinge 54 is shown provided with a dead fold living hinge, however it is contemplated that other types of integrally formed hinges, such as other types of living hinges well known in the art, may also be suitably employed.

A handle formation 56 is integrally formed into the skirt 52 on the front portion 40 and projects vertically above the peripheral edge 38 a sufficient distance to provide a positive grasping surface 58. The handle formation 56 also extends a specified distance along the length of the front portion 40, although the length of the handle formation 56 is not critical to the operation of the present invention. Due to the manufacture of the container 10 from relatively resilient plastic, the handle formation 56 is inherently pivotable from a generally vertical closed position (best seen in FIG. 1) to a rearwardly projecting open position (best seen in FIG. 3).

In the preferred embodiment, the handle formation 56 is located approximately coextensively with, and directly above, the horizontal flange 32.

Included on the front portion 40 of the lid 36 is a latch formation generally designated 60 and disposed at a lower edge 62 of the skirt 52 on said front portion 40. The latch formation 60 is provided with a groove formation 64 for matingly engaging the horizontal flange 32 of the tub portion 12. The groove formation 64 is dimensioned to tightly, yet releasably engage the flange 32.

For manufacturing purposes, the latch formation 60 includes an open pocket 66 having a forwardly projecting horizontal flange 68 which is substantially coplanar with the horizontal flange 32 as well as a flange 69 projecting from the lower edge 62 of the skirt 52. In the preferred embodiment, the latch formation 60 is disposed directly below the handle formation 56 on the front portion 40 of the lid 36, and is substantially coextensive with the horizontal flange 32. Furthermore, the handle formation 56 also is substantially coextensive with the latch formation 60.

In operation, the entire container 10 is manufactured as an integral unit. A supply of wipes 70 is placed in the tub portion 12, and the entire container is sealed, as with a clear plastic wrap, for shipment and purchase.

Figure 3:
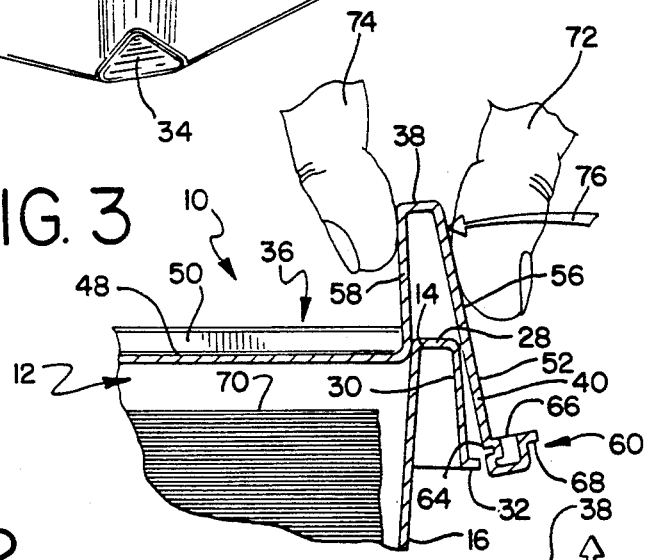
FIG. 3 is a fragmentary sectional view of the present latch shown in being opened.

Referring now to FIG. 3, upon removal of the seal (not shown), the container 10 is opened by grasping the handle formation 56 by the surfaces 58, such as by the thumb 72 and forefinger 74. The application of a rearwardly directed pressure, designated by the arrow 76, causes the handle portion to pivot backward to an open position, disengaging the groove formation 64 from the flange 32 to release the latch formation 60 and open the lid 36. The release of the handle formation 56 will cause the front portion 40 of the skirt 52 to resume its original closed position (best seen in FIG. 2).

To reclose the container 10 for the prevention of drying out of the wipes 70, the lid 36 is pressed downward until the groove formation 64 engages the horizontal flange 32. It has been found that the configuration of the latch formation 60 actually holds the groove formation 64 more securely upon the exertion of a vertical pulling force, designated by the arrow 78. Thus, the handle formation 56 may be grasped at surface 58 to lift the entire container 10 in a closed position, and the latch formation 60 will not disengage.

While a particular embodiment of the one-hand operable latch for tub type container of the invention has been shown and described, it will be appreciated by those skilled in the art that changes and modifications may be made thereto without departing from the invention in its broader aspects and as set forth in the following claims.

What is claimed is:

1. A tub-type container having a one-hand operable latch, comprising:

a tub portion with an upper edge, a front wall, a rear wall and first and second side walls, said walls integrally joined to each other;

a tub skirt depending from said upper edge of at least said front wall;

a forwardly projecting flange extending from said tub skirt along at least a portion of said front wall;

a lid including a top surface, a peripheral edge and front, rear, and first and second side portions corresponding to said walls of said tub portion and defining a lid skirt which depends from said peripheral edge;

hinge means disposed along a corresponding one of said portions of said lid and said walls of said tub portion for securing a lower edge of said lid to said tub portion;

a handle of a generally inverted U-shaped cross section integrally formed with said lid skirt and generally coextensive with said lid skirt on a front side of said handle and generally coextensive with the top surface of the lid on a rear side of said handle and projecting vertically above said peripheral edge to form a grasping surface, said handle being pivotable from a generally vertical position to a rearwardly projecting position;

latch means disposed on said lid skirt on said front portion adjacent to the front side of said handle and releasably latching said lid to said tub portion, and said latch means including a groove formation matingly engaging said flange of said tub skirt in a locked position of said latch means which corresponds to the vertical position of said handle;

said handle being arranged above said latch means so that an upwardly directed grasping force applied to said grasping surface will lift said container and maintain engagement of said latch means with said flange of said tub skirt;

wherein rearward pressure on said handle pivots said handle rearwardly and pivots said groove formation forwardly to disengage said groove formation from said flange to unlock said latch means.

2. The container as defined in claim 1 wherein said latch means is disposed directly below said handle on said front portion of said lid.

3. The container as defined in claim 1 wherein said flange is generally coextensive with said latch means.

4. The container as defined in claim 1 wherein said latch means further includes a pocket formation having a front edge substantially coplanar with a lower edge of said lid skirt.

5. The container as defined in claim 4 wherein said lid skirt extends about the entire periphery of said lid and has a lower edge with an outwardly projecting lip, said front edge of said pocket formation being substantially coplanar with said lip.

6. The container as defined in claim 1 wherein said lid is integrally joined to said tub portion.

7. The container as defined in claim 1 wherein said skirt on said lid is shorter at said rear portion than at said front portion.

8. The container as defined in claim 1 wherein said tub portion includes truncated corner formations which are generally triangular in shape.

9. A tub-type container having a one-hand operable latch comprising:

a tub portion with an upper edge, a front wall, a rear wall and first and second side walls, said walls integrally joined to each other;

a tub skirt depending from said upper edge of at least said front wall;

a forwardly projecting flange extending from said tub skirt along at least a portion of said front wall;

a lid including a top surface, a peripheral edge and front, rear, and first and second side portions corresponding to said walls of said tub portion and defining a lid skirt which depends from said peripheral edge;

hinge means disposed at said rear portion of said lid and said rear wall of said tub portion for securing a lower edge of said lid to said tub portion;

a handle of a generally inverted U-shaped cross section integrally formed into said lid skirt on a front side of said handle and integrally formed into said top surface of the lid on a rear side of said handle projecting vertically above said peripheral edge to form a grasping surface, said handle being pivotable from a generally vertical position to a rearwardly projecting position;

latch means disposed at a lower portion of said lid skirt directly below said handle on said front portion of said lid releasably latching said lid to said tub portion and including a groove formation matingly engaging said flange of said tub skirt in a locked position of said latch means which corresponds to the vertical position of said handle; and said handle is coextensive with said latch means on said front portion of said lid so that an upwardly directed grasping force applied to said handle will lift said container and maintain engagement of said latch means with said flange of said tub skirt;

wherein rearward pressure on said handle pivots said handle rearwardly and pivots said groove formation forwardly to disengage said groove formation from said flange to unlock said latch means.

10. The container as defined in claim 9 wherein said skirt on said lid is shorter in height at said rear portion than at said front portion.

* * * * *